US005238302A

United States Patent [19]

Rohan

[11] Patent Number: 5,238,302

[45] Date of Patent: Aug. 24, 1993

[54] VIBRATING MIXER FOR NAIL POLISH AND OTHER LIQUIDS

[76] Inventor: Wilma M. Rohan, 496 Old Surrey Rd., Hinsdale, Ill. 60521

[21] Appl. No.: 926,229

[22] Filed: Aug. 6, 1992

Related U.S. Application Data

[63] Continuation-in-part of Ser. No. 898,757, Jun. 12, 1992.

[51] Int. Cl.[5] ..... B01F 11/00

[52] U.S. Cl. ..... 366/110; 74/87; 366/128; 366/208

[58] Field of Search ..... 366/108, 110, 111-113, 366/128, 198, 202, 208, 209, 197, 600, 214; 74/61, 87; 494/19

[56] References Cited

U.S. PATENT DOCUMENTS

| | | | |
|---|---|---|---|
| 3,061,280 | 10/1962 | Kraft et al. | 74/87 X |
| 3,128,082 | 4/1964 | Cline | 366/128 X |
| 3,159,384 | 12/1964 | Davis | 366/110 |
| 3,199,775 | 8/1965 | Drucker | 366/217 X |
| 3,975,001 | 8/1976 | Moore et al. | 366/111 |
| 4,125,335 | 11/1978 | Blume et al. | 366/209 |
| 4,202,634 | 5/1980 | Kraft et al. | 366/111 |
| 4,479,720 | 10/1984 | Mochida et al. | 494/19 X |
| 4,848,917 | 7/1989 | Benin et al. | 366/208 |

*Primary Examiner*—Harvey C. Hornsby
*Assistant Examiner*—Charles Cooley

[57] ABSTRACT

A special mixing machine readily mixes nail polish and other liquids. The efficient mixing machine has a vibrating head assembly comprising a resilient bonnet with a series of openings to receive bottles or other containers of nail polish or other liquids. The cost effective machine also has motion producing mechanism, such as an eccentrically weighted shaft driven by a motor, which provides a vibrating driver to vibrate the bonnet and rotate (spin) the bottles so as to uniformly mix the nail polish or other liquids without forming undesirable air bubbles and foam.

10 Claims, 5 Drawing Sheets

VIBRATING MIXER FOR NAIL POLISH AND OTHER LIQUIDS

RELATED APPLICATIONS

This application is a continuation-in-part application of the patent application of Wilma M. Rohan for a Mixer for Nail Polish and Other Liquids, Ser. No. 07/898,757, filed Jun. 12, 1992, currently in Group Art Unit 2902.

BACKGROUND OF THE INVENTION

This invention pertains to mixing machines and, more particularly, to a machine for mixing bottles of nail polish.

Centuries ago, polished and colored fingernails were regarded as a symbol of aristocracy and prestige. In modern society, however, the proliferation of manicure salons provides the general public with the ability to receive professional manicures at a reasonable cost. The application of various nail polishes is an integral part of the professional manicurist's services.

Nail polish is usually sold in small jars, which have the application brush attached to the cap. Prior to the application of the polish, it must be thoroughly mixed to the proper consistency. When nail polish bottles are allowed to stand for long periods of time without being used, this often results in the separation of the polish components into layers and coagulation, in a manner similar to cans of paint that have not been used for a long time. At this point, the nail polish is usually discarded.

Furthermore, repeated exposure to the air, caused by opening and closing the jar can result in thickening or coagulation of the polish. This can sometimes be remedied by adding a few drops of nail polish thinner to the jar and then mixing the jar until the polish is of desired consistency, but this weakens the structure of the polish.

Typically, nail polish is mixed just prior to application by shaking the jar vigorously for several minutes. Many salons ask the patrons to perform this service while the manicurist prepares his or her equipment. Aside from being a tedious but necessary task, this form of mixing can cause air bubbles to appear in the polish, causing foaming, which is highly undesirable.

It is, therefore, desirable to provide an improved mixer which overcomes most, if not all, of the preceding problems.

SUMMARY OF THE INVENTION

A convenient user friendly machine is provided to easily mix nail polish and other liquids. Advantageously, the inventive machine is economical, reliable, relatively compact, portable, and effective. Desirably, this unique machine mixes nail polish and other liquids thoroughly and uniformly to produce attractive homogenous products with uniform consistency without undesirable air bubbles and foam.

To this end, the novel machine has a vibrating head assembly with a plurality of chambers which provide openings to receive bottles containing nail polish or other liquids. Preferably, the vibrating head assembly comprises a removable, soft, resilient flexible bonnet, made of foam rubber or foam rubber-like plastic, to snugly cushion the bottles so as to prevent breakage and damage to the bottles, as well as to acoustically dampen any noise generated by the mixing machine. The top and/or sides of the bonnet can have a series of openings (holes) to receive the bottles. The bottle-receiving holes can be positioned at an upward angle of inclination, relative to the vertical axis and horizontal or radial axis of the bonnet. This arrangement promotes mixing, as well as ease of insertion and removal of the bottles. While round holes are preferred, other shaped openings can be used which complement the shape of the bottles being mixed. In one form, the bonnet is generally cylindrical. In another form, the bonnet is generally box-shaped (rectangular). Different size and shaped bonnet and bottle-receiving openings can be used.

As used in this application, the term "bottle" or "bottles" includes jars, cans, vessels and other containers which contain nail polish or other liquids.

The novel mixing machine also has a motion producing mechanism(s), which is operatively associated and connected to the head assembly to rotate (spin) the bottles around the axes of the openings of the chambers to completely and efficiently mix the nail polish or other liquids in the bottles. The motion producing mechanism can have rotating components and vibrating components. In the preferred form, the motion producing mechanisms include an eccentrically weighted shaft driven by a motor. The eccentrically weighted shaft provides part of a circularly rotating vibrating driver (head) which engages and is detachably coupled to a socket (hole) in the bonnet. The eccentrically weighted shaft gently, smoothly and effectively vibrates the bonnet and the bottles inserted therein, which contain the nail polish or other liquids to be mixed.

The vibrating nail polish mixer provides a high quality convenient machine for professional manicurists and end users. Advantageously, the inventive machine provides an automatic method for mixing nail polish which keeps the nail polish fresh throughout the day without having to hand shake each bottle prior to each application. The machine will mix many bottles of nail polish simultaneously, such as 2–16 bottles or more of nail polish, and keep these bottles fresh and ready for use.

The vibrating nail polish mixer is a safe and quiet electromechanical device that mixes nail polish with a combination of rotation and vibration. When the mixer is turned on, the nail polish bottles spin in place while gently vibrating, providing a thorough and uniform mixing. While the vibrating mixing machine is particularly useful for mixing nail polish, it can also be used to mix other liquids, such as: paint, plasma and blood, and other colloidal suspensions and liquids, etc. A more detailed explanation of the invention is provided in the following description and claims taken in conjunction with the accompanying drawings.

DETAILED DESCRIPTION OF THE PREFERRED EMBODIMENTS

Figure 1:
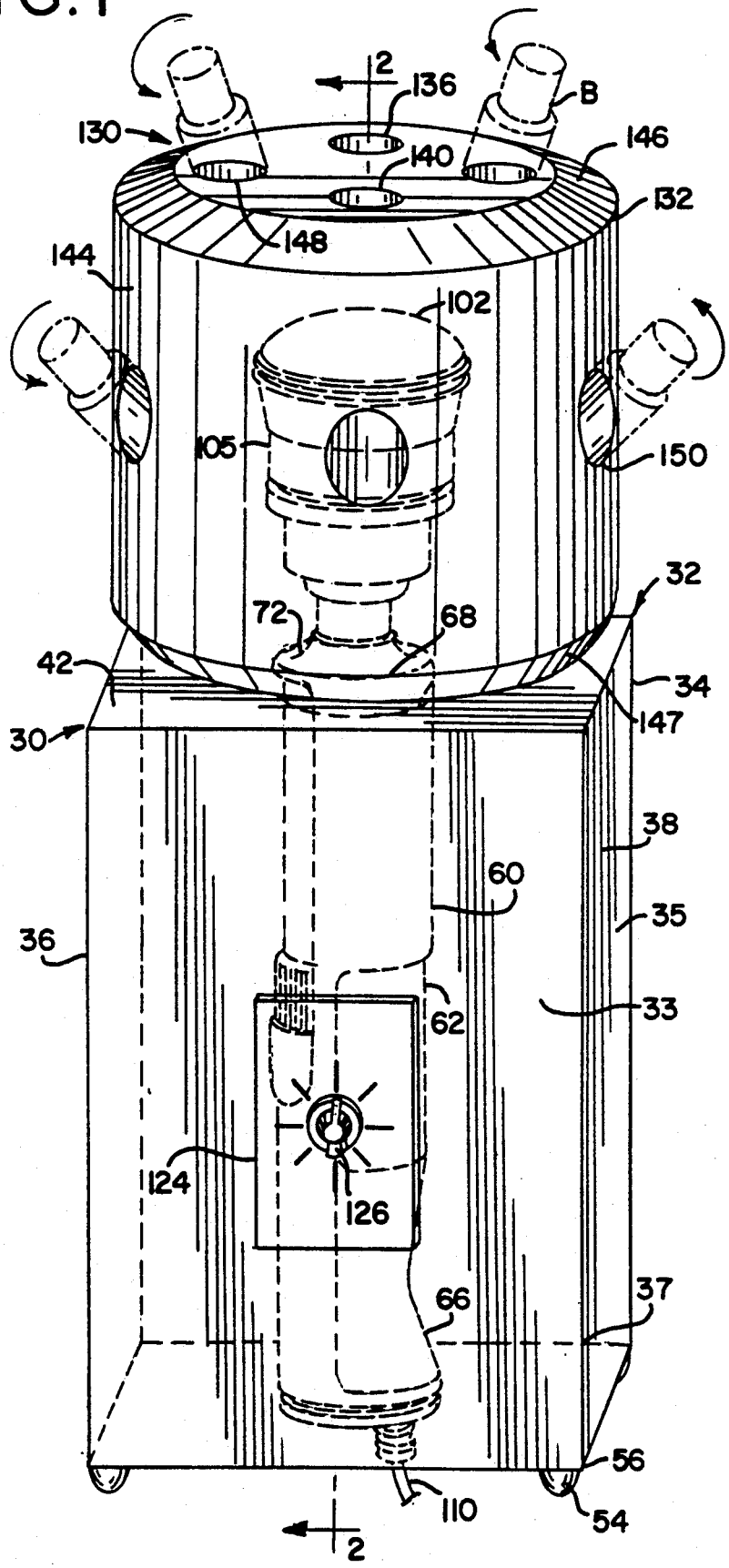
FIG. 1 is a perspective view of a mixing machine in accordance with principles of the present invention.

Referring to FIGS. 1–6, a vibrating mixing machine provides an effective, easy-to-use mixer, apparatus and assembly to vibrate, rotate, and mix bottles B containing nail polish or other liquids.

The machine 30 has a rectangular housing 32 made of metal, wood, or impact-resistant plastic. The housing 32 has upright vertical generally planar or flat, rectangular sidewalls 33–36 including a front wall 33 and a back rearward wall 34. The sidewalls have lower portions 37 and upper portions 38. A support base 40 (FIG. 2) extends horizontally between and is connected by fasteners, adhesive, or welded to the lower portions 37 of the sidewalls 33–36. The base 40 provides the floor of the housing 32. A planar of flat top 42 extends horizontally between and is connected by fasteners, adhesive, or welded to the upper portions 38 of the sidewalls 33–36. The top 42 provides the ceiling of the housing 32. The top 42 and base 40 have central intermediate portions 44 and 46 with coaxially aligned vibrating unit-receiving openings or holes 48 and 50. The housing 32 also has an electric cord-receiving opening or hole 52. Elevating and stabilizing feet 54 extend downwardly from and are connected to the walls 33–36 of the housing 32 by fasteners at a location adjacent the bottom corners 56.

Figure 2:
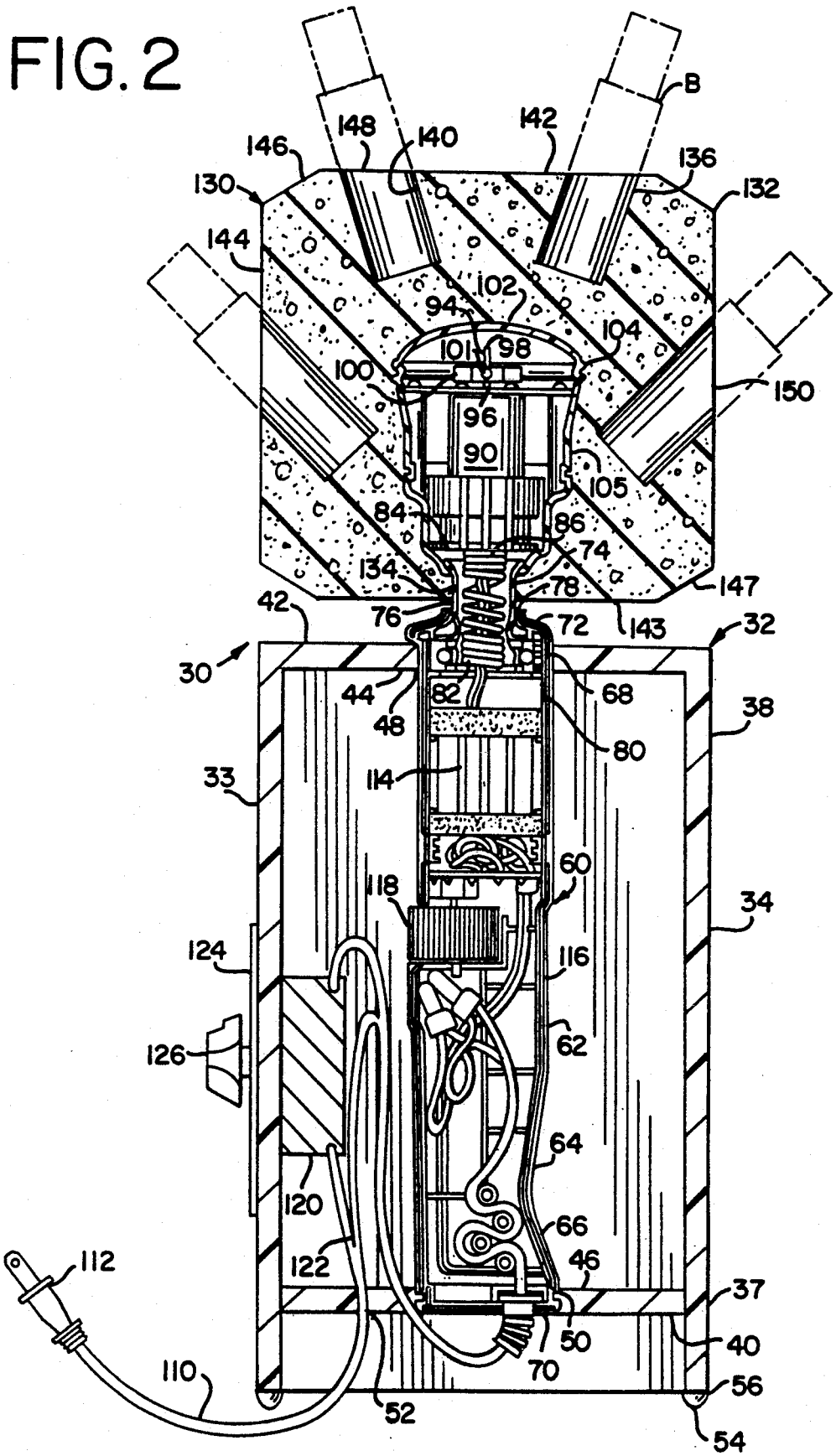
FIG. 2 is a cross-sectional view of the mixing machine taken substantially along lines 2—2 of FIG. 1.
Figure 3:
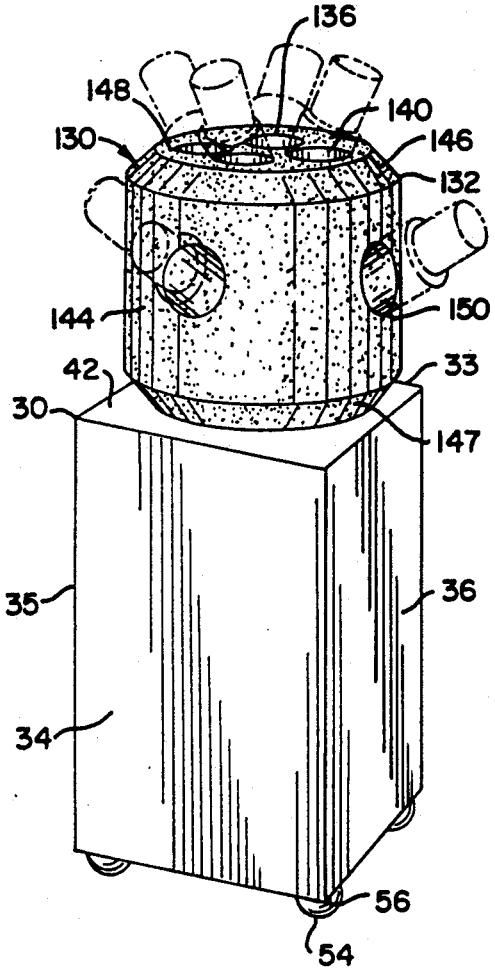
FIG. 3 is a reduced backside view of the mixing machine.
Figure 4:
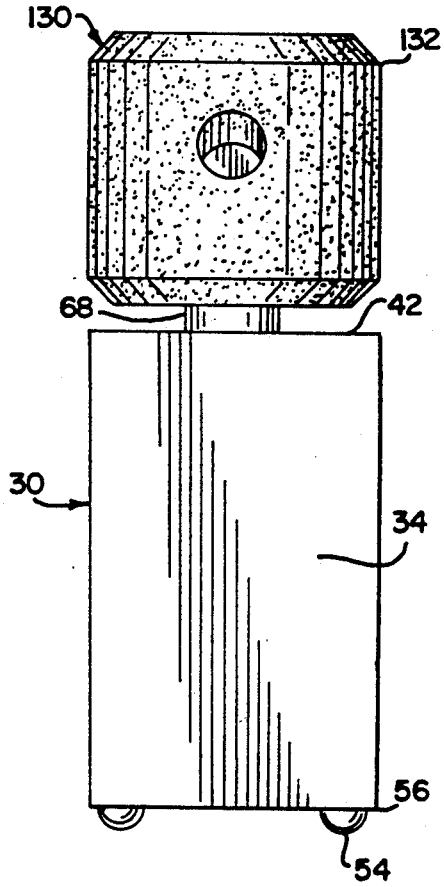
FIG. 4 is a back view of the mixing machine.
Figure 5:
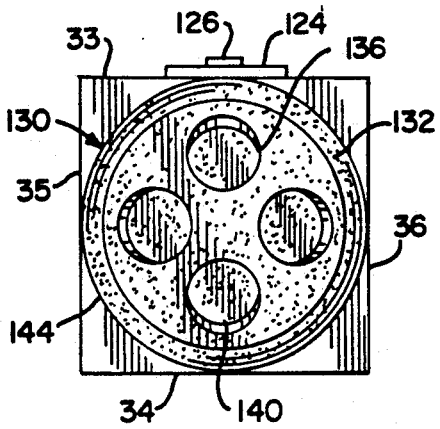
FIG. 5 is a top view of the mixing machine.
Figure 6:
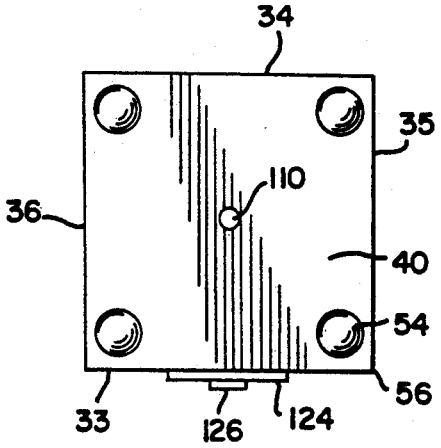
FIG. 6 is a bottom view of the mixing machine.
Figure 7:
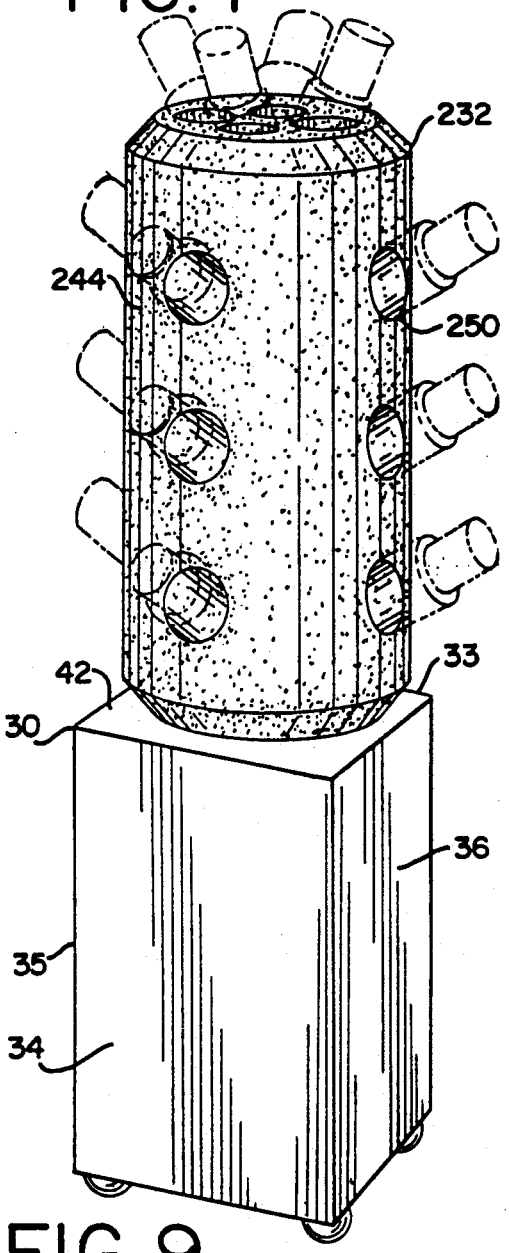
FIG. 7 is a backside perspective view of a mixing machine with another foam rubber head (bonnet) in accordance with principles of the present invention.
Figure 8:
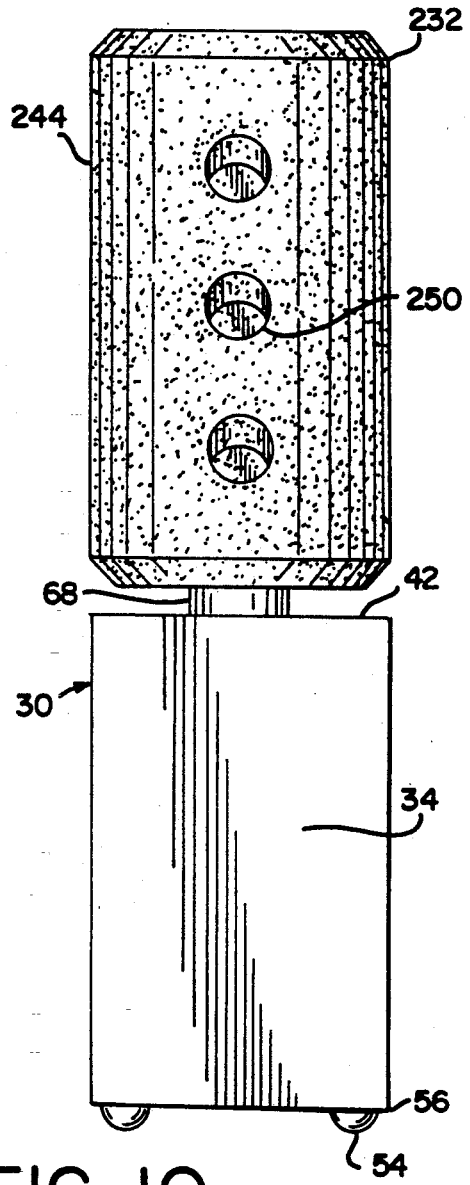
FIG. 8 is a back view of the mixing machine of FIG. 7.
Figure 9:
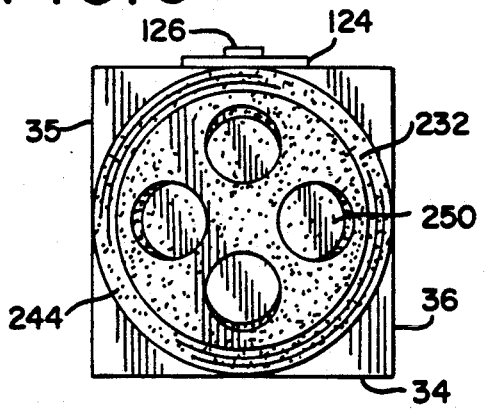
FIG. 9 is a top view of the mixing machine of FIG. 7.
Figure 10:
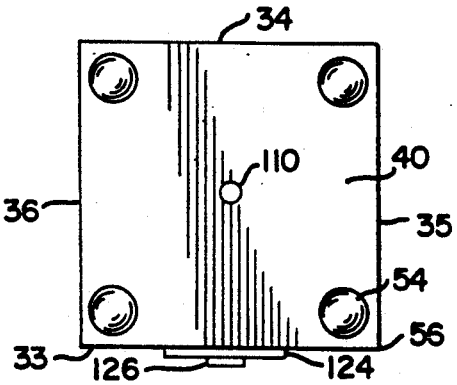
FIG. 10 is a bottom view of the mixing machine of FIG. 7.

As shown in FIG. 2, the mixing machine 30 has a vibrating unit (vibrator) 60 with a truncated protective handle-like sheath 62. The sheath 62 is mounted in the interior of the housing 32 between the base 40 and the top 42. The base 40 engages and supports the vibrating unit 60 in a vertical upright position. The sheath 62 is made of an acoustical dampening, sound resistant, impact-resistant plastic. The sheath 62 has elongated arcuate flared sidewalls 64 with lower sections 66 and upper sections 68. The upper sections 68 extend vertically upwardly through the upper opening 48 of the top 42 of the housing 32. The sheath 62 has an arcuate bottom end 70 or underside. The bottom end 70 of the sheath 62 extends laterally between and is connected to the lower sections 66 of the flared sidewalls 64. The bottom end 70 of the sheath 62 also is positioned in the countersunk opening or hole 50 of the base 40 of the housing 32. The sheath 62 has a convex domed annular upper end or caps 72 which extends laterally between and is connected to the upper sections 68 of the flared sidewalls 64. The domed upper end 72 of the sheath 62 is positioned above the ceiling 42 of the housing 32.

The vibrating unit 60 has a spiral compression spring 74 with spiral or helical coils 76 that extend upwardly through a spring-receiving opening 78 of the domed upper end 72 of the sheath 62. The spring 74 is coaxially aligned with the spring-receiving opening 78 and the coaxially aligned openings 48 and 50 of the top 42 and base 40 of the housing 32. A lower mounting bracket 80 is fastened or otherwise secured to the lower spiral end 82 of the spring 74. The lower mounting bracket 80 is positioned in the interior of the sheath 62 in proximity to the domed upper end 72. The lower mounting bracket 80 spans a lateral distance greater than the diameter of the spring-receiving opening 78 of the sheath 60 but less than the maximum lateral internal span between the flared sidewalls 64. An upper mounting bracket 84 is positioned above the top 42 of the housing 32 and spring 74. The upper mounting bracket 84 is fastened or otherwise secured to the upper spiral end 86 of the spring 74.

A power driven DC motor 90 is fastened to or otherwise fixedly secured and mounted upon the upper surface of the upper mounting bracket 84. The motor 90 is located above the spring 74, upper mounting bracket 84, and ceiling 42 of the housing 32. A cantilevered vibrating shaft 94 provides a rotatable rod with an attached lower end portion 96 connected to and driven by the motor 90. The shaft 94 has a cantilevered, unattached, free, upper end portion 98 which extend above the motor 90. An eccentric weight 100 is fastened with a set screw 101 or otherwise eccentrically fixedly secured to the upper end portion 98 of the shaft 94. In operation, the shaft 94 rotates in a conical motion and pattern with the shaft's lower end portion 96 providing an apex and the shaft's upper end portion 98 rotates in a circular base motion and pattern.

The vibrating unit 60 has an enlarged rounded vibrating head 102 comprising a nail polish-impermeable, liquid impervious, convex plastic cover 104 with a downwardly depending flexible skirt 105 which substantially encloses and protectively covers the motor 90, shaft 94, eccentric weight 100 and upper mounting bracket 84.

An electric power cord 110 extends through an electric power cord-receiving opening 52 in the housing 32. The power cord 110 has an outlet plug 112 which connects and plugs into an electric socket and outlet receptacle (not shown) such as in the wall of an office, store, or home. The electric socket and outlet receptacle provide an alternating current power source. The electric power cord 110 is connected to a converter 114 or transformer to convert alternating current (AC) from the alternating current power source to direct current (DC) to power the motor 90, via electric wires 116 connecting the motor 90 and converter 114. An on-off speed control switch 118 can be connected to the electric wires 116 to vary the operating speed of the motor and the magnitude of the vibrations. A timing mechanism 120 comprising an electric timer selectively controls the mixing time of the vibrating head 102. The timing mechanism 120 is connected via electric wires 122 to the electric power cord 110 within the interior of the housing 32. The timing mechanism 120 is fastened or otherwise secured to the inwardly facing surface of the front wall 33. The timing mechanism 120 has a face plate 124 which is fastened or otherwise mounted against the exterior surface of the front wall 33. The timing mechanism 120 also has a manual control knob 126 which provides a timer dial that extends outwardly of the exterior surface of the front wall 33 to select the vibration and mixing time.

The mixing machine 30 has a resilient, flexible, soft elastomeric head 130 that is made of foam- or sponge rubber or synthetic foam rubber-like plastic. The elastomeric head comprises an enlarged removable bonnet 132 that is positioned above the housing 32. The bonnet 132 has a downwardly facing axial socket 134 or opening that snugly receives, elastomerically engages, couples with, and contacts the vibrating head 102. The bonnet 132 has a series, set and array of chambers 136 or departments comprising bottle-receiving openings or holes 140 into which the bottles of nail polish or other liquid are inserted and removed. The openings 140 rotatively receive, elastomerically engage, and softly contact the bottles of nail polish or other liquids.

In use, when the power is turned on and the motor 90 is activated, the vibrating head 102, which is detachably coupled to the bonnet 132, vibrates the bonnet 132 and spins (rotates) the bottles about the axis of each of the holes 140 into which they are inserted to smoothly, uniformly, thoroughly, and homogeneously mix the nail polish or other liquids in the bottles without producing any detrimental air bubbles or foam. Advantageously, the soft elastomeric bonnet 132 cushions the bottles to prevent the bottles from breaking or being damaged and also provides an acoustical insulating absorber to quiet noises generated by the vibrating head 102 and motor 90.

In the embodiment of FIGS. 1-5, the bonnet 132 is cylindrical with planar or flat, bottle-receiving top and bottom portions 142 and 143, a vertical, upright circular bottle-receiving sidewall 144, and upper and lower circular beveled edges 146 and 147 which intersect and connect the sidewall 144 to the top and bottom portions 142 and 143. There are four symmetrical bottle-receiving openings 148 or holes in the top portion and four symmetrical bottle-receiving openings or holes 150 in the sidewall 144. The bottle-receiving openings or holes 148 and 150 are positioned at an upward angle of inclination, ranging from 15 degrees to 75 degrees, preferably from 30 degrees to 60 degrees, and most preferably about 45 degrees, relative to the vertical axis of the bonnet 132 and the horizontal radial axis of the bonnet 132. The bonnet 132 holds up to eight jars of nail polish.

The bonnet 232 of FIGS. 7-10 is structurally and functionally similar to the bonnet 132 of FIGS. 1-6, except that it is taller and has 12 symmetrically aligned bottle-receiving openings or holes 250 in the sidewall 244.

Figure 11:
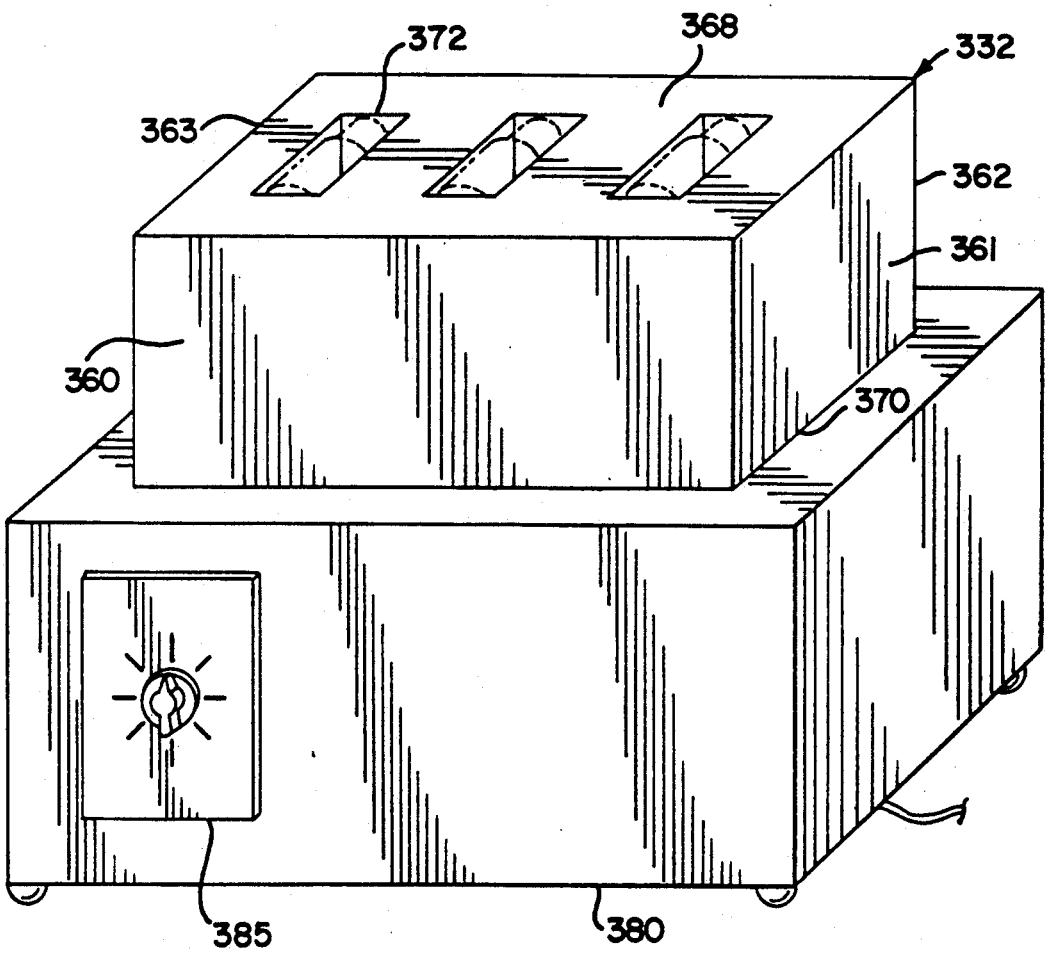
FIG. 11 is a perspective view another mixing machine and foam rubber head (bonnet) in accordance with principles of the present invention.

The bonnet 332 of FIG. 11 is structurally and functionally similar to the bonnet 132 of FIG. 1, except that it is rectangular and box-like. The rectangular bonnet 332 has rectangular sidewalls 360-364 and rectangular top and bottom walls 368 and 370. The bottle-receiving openings, slots or holes 372 are rectangular or otherwise shaped complementary to the shape of the bottles which are to be inserted therein so that the elastomeric wall portions surrounding the holes 372 matingly engage and softly contact the bottles.

The vibrating nail polish mixing machine 30 provides an automatic method for mixing nail polish and keeping it fresh throughout the day, without having to hand shake each bottle prior to each application. The nail polish mixer 30 will mix as many as little as 2 and as many as 16 bottles of nail polish simultaneously, and keep these bottles freshly mixed as long as the unit is turned on.

The vibrating nail polish mixing machine 30 provides a user friendly, electromechanical device that mixes the polish with a combination of rotation and vibration with a smooth air bubble-free consistency, so that the polish is always ready to use instantly. When the machine 30 is turned on, the nail polish jars spin in place while gently vibrating, thereby providing thorough and uniform mixing.

The vibrating nail polish mixer 30 provides air bubble-free continuous mixing. This not only eliminates the possible foaming effect of hand shaking the bottles, but also extends the usable life of the nail polish by preventing the separation of polish components and preventing coagulation. In addition, neither the salon patron nor the manicurist have to undertake the tedious, time-consuming chore of hand shaking each bottle before each and every use.

As discussed above, the machine 30 has a vibrating unit 60 controlled by a timer 120 and a foam rubber head 130 comprising a bonnet 132 that holds the nail polish jars.

In operation, nail polish jars are inserted into openings in the foam rubber bonnet 132 and the timer 120 is set for the desired mixing interval of operation. The vibrating unit 60 begins to vibrate the foam rubber bonnet 132 gently, causing the jars to rotate and spin about the axes of the bottle-receiving openings 140. The mixer 30 will continue to mix the nail polish until the timer 120 interval has expired. The salon manicurist could, therefore, use the mixer 30 to keep his or her nail polish ready to use throughout the day.

One of the many unique features of the mixing machine 30 is its ability to vibrate and rotate the foam rubber bonnet 132 in a circular motion. This circular motion is extremely fast. This vibratory effect produces vibratory action and simultaneous motion in tiny circles.

The sheath 62 or handle of the vibrator 60 contains the AC to DC power supply converter 114 and switch assembly 118. The power supply converter 114 converts 110 volts AC from the wall socket to the 2.4 volts DC required by the vibrator's motor 90, which is located adjacent the vibrating head 102 of the vibrator (vibrating unit) 60. The vibrating head 102 of the unit 60 is connected to the handle with a coil spring 74. This allows the vibrating head 102 to vibrate freely, while reducing vibration to the sheath 62. The DC motor 90, located in proximity to the vibrating head 102 of the unit 60, provides the actual circular vibration. The DC motor 90 is mounted securely to one end of the coil spring 74. The other end of the coil spring 74 is mounted securely to the sheath 62 of the vibrating unit 60.

On the shaft 94 of the DC motor 90 is an eccentric weight 100, i.e. a weight that is mounted to the shaft 94 off-center. The inertia of the weight 100 causes the shaft 94 of the motor 90 to be pulled in a circle due to centrifugal force. This causes the motor 90, and also the vibrator head 102 to which it is mounted, to exert force in a circular direction each time the motor shaft 94 rotates. This force causes the coil spring 74 mount to flex, also in a circular direction. The effect is somewhat akin to the way an improperly balanced automobile tire causes excessive vibration at highway speeds.

Since the DC motor 90 is rotating at high speed, this circular flexing of the coil spring 74 is perceived as a vibration at the vibrator head 102. In actuality, the vibrating head 102 of the vibrator 60 moves in small circles at a substantial rate.

The foam rubber head 130 comprising the bonnet 132 of the vibrating nail polish mixer 30 is supported entirely by the vibrator head 102, causing it to vibrate at the same rate as the vibrator head 102. The foam bonnet 132 is moved in small circles at a substantial rate. If viewed without any nail polish jars inserted, the foam rubber bonnet 132 appears to vibrate, and the fact that it is moving in small circles is not apparent. When jars of nail polish are inserted into the holes in the foam rubber bonnet 132, the sides of the jars are making frictional contact with the foam rubber of the head 130. The jars are much denser (heavier, for a given volume) than the foam rubber head 130. The density of the jars causes their inertia to be much greater than that of the foam rubber head 130. Although the foam rubber head 130 is moving in small circles and is attempting to move the nail polish jars in small circles, the jars cannot keep up with the speed of the foam rubber head 130. The walls of the holes in the foam rubber head 130 comprising the bonnet 132 compress as they attempt to move the jars. This compression varies in direction as the foam rubber head 130 moves in its small circle. The force that is exerted on the sides of the jar travels in a circle around the jar. This causes the jar to spin inside the bonnet's hole 140 into which it is inserted. This produces the desired spinning form of rotational motion for the nail polish mixer 30.

In one prototype model of the mixing machine, a standard circular motion hand-held vibrator was provided as the vibrating unit. The vibrating unit was mounted vertically in the base of the housing. The sheath or handle portion of the vibrator was securely mounted in the base of the housing, while the head of the vibrator was inserted into the foam rubber bonnet. The foam rubber bonnet was supported entirely by the vibrator head, causing it to vibrate at the same rate as the vibrator head. The vibrating unit was connected to a standard rotary electrical timer. The foam rubber head (bonnet) was cylindrical in shape, with eight holes of 1½ inch diameter drilled into the head, four on the flat top of the head, and four at equal aliquot intervals around the sides of the head. The holes on the sides were drilled in at a 60 degree angle to keep the jars from falling out. It was also unexpectedly and surprisingly found that the inclined bottle-receiving opening promote better mixing. The diameter of the bottle-receiving opening was selected to fit most standard nail polish jars. The prototype model of the mixing unit was successfully tested with many different types of nail polish.

The major differences between the embodiments of FIGS. 1–7 and 11, are the shape of the foam rubber head (bonnet) and the vibration unit. In the embodiment of FIG. 11, the bonnet 332 of the foam rubber head and bottle-receiving openings 372 are rectangular in shape and holds three nail polish jars, each on its side in a cylindrical cradle. The vibrational unit can be a standard circular motion hand-held vibrator, but with a right angle vibration head. This allows for a shorter rectangular housing 380 with a lower profile for placement on shelves and more compact storage. A timer 385 can be placed in an offset position on the front of the housing 380.

The foam rubber head (bonnet) can have different diameter holes to accommodate larger diameter and odd shaped nail polish bottles.

Among the many advantages of the vibrating mixing machine are:

1. Outstanding performance and mixing capability for nail polish.
2. Smooth excellent mixing of nail polish and other liquids.
3. Avoids air bubbles and foaming.
4. Minimizes coagulation and separation of the compounds in the liquid being mixed.
5. Keeps nail polish fresh and reduces spoilage and wastage of the product being mixed.
6. Improves color consistency and appearance of the nail polish.
7. Helps prevent peeling and chipping of the polish which is to be applied to finger nails or toe nails.
8. Eliminates manual mixing.
9. Saves time.
10. User friendly.
11. Impressive.
12. Cost effective.
13. Simple to operate.
14. Superb quality.
15. Economical.
16. Reliable.
17. Efficient.
18. Effective.

Although embodiments of the invention have been shown and described, it is to be understood that various modifications and substitutions, as well as rearrangements of parts, components, process and operating steps, can be made by those skilled in the art without departing from the novel spirit and scope of this invention.

What is claimed is:

1. A machine for mixing bottles containing nail polish or other liquids, comprising:

a flexible elastomeric head having a plurality of chambers for receiving bottles containing nail polish or other liquids, said flexible elastomeric head defining a downwardly facing socket;

a vibrating unit connected to said resilient flexible elastomeric head for vibrating said flexible elastomeric head and for spinning said bottles in said chambers to substantially mix said nail polish or other liquids in said bottles, said vibrating unit comprising a compression spring, a motor mounted on said compression spring, an eccentrically weighted shaft driven by said motor, and a vibrating head substantially enclosing said motor and said shaft, and said vibrating head snugly engaging said socket for vibrating said flexible elastomeric head to spin said bottles in said chambers.

2. A machine in accordance with claim 1 wherein said chambers comprise substantially symmetrical cylindrical holes positioned at an angle of inclination relative to each other about a vertical axis of said flexible elastomeric head.

3. A machine for mixing bottles containing nail polish or other liquids, comprising:

a housing having upright sidewalls with upper portions and lower portions, a support base extending substantially horizontally and connecting said lower portions of said sidewalls for providing a bottom of said housing, a substantially planar top providing a ceiling extending substantially horizontally between and connecting said upper portions of said sidewalls, said top and said base defining central portions defining substantially coaxially aligned openings, and said housing defining an electric cord-receiving hole;

a vibrating unit having a truncated protective sheath mounted in the interior of said housing between said base and said top, said base engaging and supporting said vibrating unit in a substantially vertical position, said sheath comprising an acoustical dampening impact-resistant plastic, said sheath having elongated flared sidewalls with lower sections and upper sections, said upper sections extending upwardly through the opening of the top of said housing, an arcuate bottom end providing an underside extending laterally between and connecting said lower sections of said flared sidewalls and positioned in said opening of said base, a domed annular upper end extending laterally between and connecting said upper sections of said flared sidewalls and disposed above said ceiling of said housing, said domed annular upper end defining a spring-receiving opening, a spiral compression spring extending upwardly through said spring-receiving opening of said domed upper end of said sheath, said spring being substantially coaxially aligned with said spring-receiving opening and said openings in said housing, said spring having a lower spiral end and an upper spiral end, a lower mounting bracket secured to said lower spiral end of said spring and positioned in the interior of said sheath beneath and in proximity to said domed upper end, said lower mounting bracket spanning a lateral distance greater than the diameter of said spring-receiving opening but less than a maximum lateral internal span of said flared sidewalls, an upper mounting bracket disposed above the top of said housing and secured to said upper spiral end of said compression spring, said upper mounting bracket having an upper surface, a power-driven vibrating motor mounted upon and fixedly secured to the upper surface of said upper mounting bracket above the ceiling of said housing, a cantilevered vibrating shaft having an attached lower end portion connected to and driven by said motor, said shaft having an unattached free upper end portion extending above said motor, an eccentric weight fixedly secured to said upper end portion of said shaft, said shaft rotating in a conical motion with said lower end portion defining an apex and said upper end portion rotating in a substantially circular pattern, a vibrating head comprising a nail polish-impermeable and substantially liquid impervious plastic cover for substantially enclosing and protectively covering said motor, said shaft, said eccentric weight and said upper mounting bracket, a power cord extending through said cord-receiving hole of said housing and having an outlet plug for connection to an alternating current power source, a converter positioned in the interior of said sheath in proximity to said lower sections of said flared sidewalls and electrically connected to said power cord for converting alternating current from said alternating current power source to direct current for powering said motor, said motor being electrically connected to said converter; and a resilient flexible elastomeric head providing an enlarged removable bonnet positioned above said housing, said bonnet defining a downwardly facing socket for snugly receiving and engaging said vibrating head, said bonnet defining an array of chambers comprising bottle-receiving openings for rotatively and engaging bottles containing said nail polish or other liquids, and said vibrating head being detachably coupled to said elastomeric head for vibrating said bonnet and spinning said bottles without breaking and damaging said bottles to substantially mix said nail polish or other liquids in the absence of a substantial amount of air bubbles.

4. A machine in accordance with claim 3 including a timing mechanism electrically connected to said power cord and said converter and mounted against one of said sidewalls of said housing for selectively controlling the mixing time of said vibrating head.

5. A machine in accordance with claim 4 wherein said housing has elevating and stabilizing feet and said, timing mechanism has a control knob providing a timer dial on the exterior of said housing.

6. A machine in accordance with claim 3 wherein said bonnet is substantially rectangular and said bottle receiving openings are substantially rectangular.

7. A machine in accordance with claim 3 wherein said bonnet is substantially cylindrical with a bottle-receiving sidewall, a bottle-receiving top portion, and an upper beveled edge connecting said bottle-receiving top portion to said bottle-receiving sidewall.

8. A machine in accordance with claim 7 wherein said bonnet defines a symmetrical array of bottle-receiving openings about a vertical axis of said bonnet.

9. A machine in accordance with claim 8 wherein said top portion of said bonnet defines four bottle-receiving openings.

10. A machine in accordance with claim 8 wherein said sidewall of said bonnet defines a horizontal radial axis and at least four bottle-receiving openings are positioned at an angle of inclination relative to said horizontal radial axis.

* * * * *